US007134968B1

(12) United States Patent
Pryor

(10) Patent No.: US 7,134,968 B1
(45) Date of Patent: Nov. 14, 2006

(54) GOLF SWING TRAINING AND EXERCISING DEVICE

(76) Inventor: J. R. Pryor, 2295 Rosemary Ct., Montgomery, IL (US) 60538

( * ) Notice: Subject to any disclaimer, the term of this patent is extended or adjusted under 35 U.S.C. 154(b) by 7 days.

(21) Appl. No.: 11/167,483

(22) Filed: Jun. 27, 2005

(51) Int. Cl.
*A63B 69/36* (2006.01)

(52) U.S. Cl. ..... 473/257; 473/229; 482/120

(58) Field of Classification Search ..... 473/207, 473/212–219, 226–229, 257, 258; 482/120, 482/127, 129
See application file for complete search history.

(56) References Cited

U.S. PATENT DOCUMENTS

| | | | | | |
|---|---|---|---|---|---|
| 518,967 | A | | 5/1894 | Poole | |
| 1,137,349 | A | | 4/1915 | Patterson | |
| 3,462,156 | A | * | 8/1969 | Gentry | 473/229 |
| 3,804,420 | A | | 4/1974 | Boyd | |
| 4,114,875 | A | * | 9/1978 | Deluty | 482/120 |
| 4,134,589 | A | | 1/1979 | Arena | |
| 4,135,714 | A | | 1/1979 | Hughes | |
| 4,253,663 | A | | 3/1981 | Hughes | |
| 4,557,480 | A | * | 12/1985 | Dudley | 482/120 |
| RE32,397 | E | | 4/1987 | Self | |
| 5,397,122 | A | | 3/1995 | Herridge | |
| 5,769,734 | A | | 6/1998 | Qualey | |
| 5,816,928 | A | * | 10/1998 | Colonna | 473/229 |
| 5,947,835 | A | | 9/1999 | Fenton, Jr. | |
| 6,413,196 | B1 | * | 7/2002 | Crowson | 482/118 |
| 6,659,922 | B1 | * | 12/2003 | Yu | 482/127 |
| 6,699,141 | B1 | | 3/2004 | Florian | |
| 6,783,464 | B1 | | 8/2004 | Romano | |
| 6,805,640 | B1 | | 10/2004 | Kim | |
| 6,805,641 | B1 | | 10/2004 | Pope | |
| 6,855,065 | B1 | | 2/2005 | Hamilton | |
| 6,863,616 | B1 | | 3/2005 | Snyder | |
| 2002/0025892 | A1 | | 2/2002 | Chapman | |
| 2004/0097296 | A1 | * | 5/2004 | Snyder et al. | 473/212 |
| 2004/0152534 | A1 | | 8/2004 | Chapman | |

* cited by examiner

*Primary Examiner*—Nini F. Legesse

(57) ABSTRACT

A golf swing training and exercise device incorporates a spring-loaded retraction reel which pays out and pulls back a flexible cord which is releasably attached to the shank of a golf club a practice training wand simulating a golf club, or alternatively to an attachment point on the user's practice glove. The important muscles for the user's golf swing are trained and strengthened by repeatedly pulling the cord against the tension of the reel. To make the path of each golf swing more visible to the user, the cord is made of a highly visible material. Additionally, a lightweight simulated golf ball is slidably attached to the cord to simulate an actual golf ball addressed by before each swing. The reel has a multi-function attachment means by which it may be secured to a fixed stake or post, or to the forward edge of a golf practice mat, or to the turf or sod of a golf playing surface.

5 Claims, 6 Drawing Sheets

GOLF SWING TRAINING AND EXERCISING DEVICE

FIELD OF THE INVENTION

This invention relates to athletic exercise and training equipment, and in particular to the strengthening and training of the muscles important to providing golf players with a powerful and consistent swing which enables them to accurately and consistently hit a golf ball in a way that lowers their golf scores and makes the game more enjoyable.

BACKGROUND OF THE INVENTION

Golf can be a very enjoyable game, but it is hard for a beginner to learn the basics of a smooth, consistent and powerful swing. For a person just beginning to learn the game, a great deal of time and effort are required to "teach" the muscles of the hands, arms, legs and back the specialized coordinated movement required to hit a golf ball powerfully and consistently. For this reason the beginning golfer may seek the assistance of a mechanical device to train and improve his or her golf swing more quickly, efficiently and economically than by going to a golf course or driving range and trying to hit the ball without some sort of guidance or assistance in developing a proper golf swing.

The key to a proper golf swing is, of course, the backswing. Without a proper backswing or "takeaway", the downswing through the ball impact zone cannot be delivered consistently and under proper control, which means that the ball may be hit unpredictably, or not at all. This must be followed by a smooth and consistent follow-through, which connects all the other elements of the swing into the kind of unified fluid and repeatable movement which is so important to playing an enjoyable game of golf.

It is also very important for a golfer to learn a proper swing early and not to develop bad habits which must later be unlearned with great difficulty. In addition, proper initial training enables the golfer to develop and retain a "muscle memory" which insures that each golf shot can be made controllably and predictably.

The present invention achieves these objectives by assisting the golfer to both see and feel these important swing elements which would otherwise be very difficult to visualize.

The prior art includes many devices conceived and intended to help a golfer improve his or her golf swing, but none disclose or suggest the use of a visible retractable cord as a training aid for visibly indicating the direction or path of the swing. The following are just a few examples.

A spring-loaded reel or pulley is disclosed by Hughes U.S. Pat. No. 4,253,663 and U.S. Pat. No. 4,135,714 in which the reel resiliently pays out or pulls in a cord which attaches to a golf-club simulating handle. The reel is positioned on a post or beam above and behind the user's head so that by swinging the handle downward against the resistance of the reel, the device provides a form of exercise or muscle development. Similar reels are shown in older prior art such as Poole U.S. Pat. No. 518,967, Patterson U.S. Pat. No. 1,137,349, and Boyd U.S. Pat. No. 3,804,420.

Fenton, Jr. U.S. Pat. No. 5,947,835 and Qualey, Sr. U.S. Pat. No. 5,769,734 disclose golf club-like exercise training devices in which the club portion contains or is attached to a weight retained by a resilient cord, but neither uses the cord as training aid for visibly indicating the direction or path of the swing.

Several prior art devices utilize physical restraints, much like prosthetic devices, to train the user to execute a presumably improved golf swing. These include Herridge II U.S. Pat. No. 5,397,122, Romano U.S. Pat. No. 6,783,464, Kim et al. U.S. Pat. No. 6,805,640 and Snyder et al. U.S. Pat. No. 6,863,616. All of these devices constrain the user's range of movement in some way, and none disclose or suggest the use of a flexible cord as a visible swing path indicator.

An additional group of prior art documents disclose various mechanical devices which, in Draconian fashion, force the user to assume physical postures and patterns of golf swing movement as dictated by their mechanisms, and not as taught by free repetitive movement as in the previously described patents, and as provided for by the present invention. These documents include Arena U.S. Pat. No. 4,134,589, Self et Al. Re. 32,397, Perry et al. U.S. Pat. No. 5,303,927, Florain U.S. Pat. No. 6,699,141, Pope U.S. Pat. No. 6,805,641, Hamilton, U.S. Pat. No. 6,855,065, and Chapman et al. App. US 2002/0025892 and US 2004/0152534. Like all the previously described disclosures, none of these disclose or suggest the use of a flexible cord as a visible swing path indicator.

SUMMARY OF THE INVENTION

The present invention is a golf swing training and exercise device incorporating a tensioned reel which pays out and pulls back a flexible cord which is releasably attached to the shank of a golf club, a practice training wand simulating a golf club, or alternatively to an attachment point on the user's practice glove. By repeatedly pulling drawing the cord against the tension of the reel, the invention helps train and strengthen the important muscles used in the user's golf swing.

As a feature of the invention, the cord is made of a highly visible material to make the path of each golf swing more visible to the user. Additionally, a lightweight simulated golf ball is slidably attached to the cord to simulate an actual golf ball addressed by before each swing.

The tensioned reel is provided with a multi-function attachment means by which it may be secured to a variety of anchor points, such as a fixed stake or post, or to the forward edge of a golf practice mat, or to the turf or sod of a golf playing surface.

A BRIEF DESCRIPTION OF THE DRAWINGS

FIG. 1 is a perspective view of the device of the present invention showing a spring-loaded retraction reel 1 connected to a golf-club like training wand 6 by a highly visible flexible cord 2, to which is attached a lightweight simulated golf ball.

Figure 1:
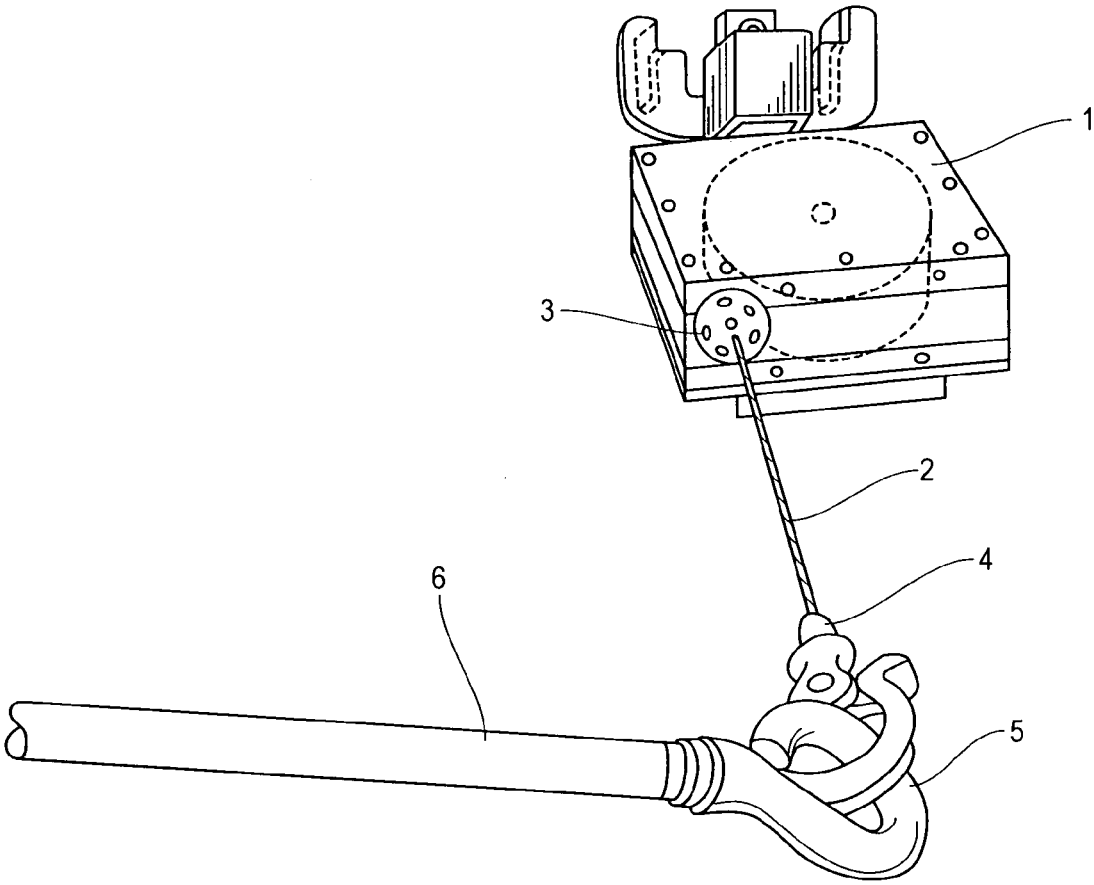
Figure 4:
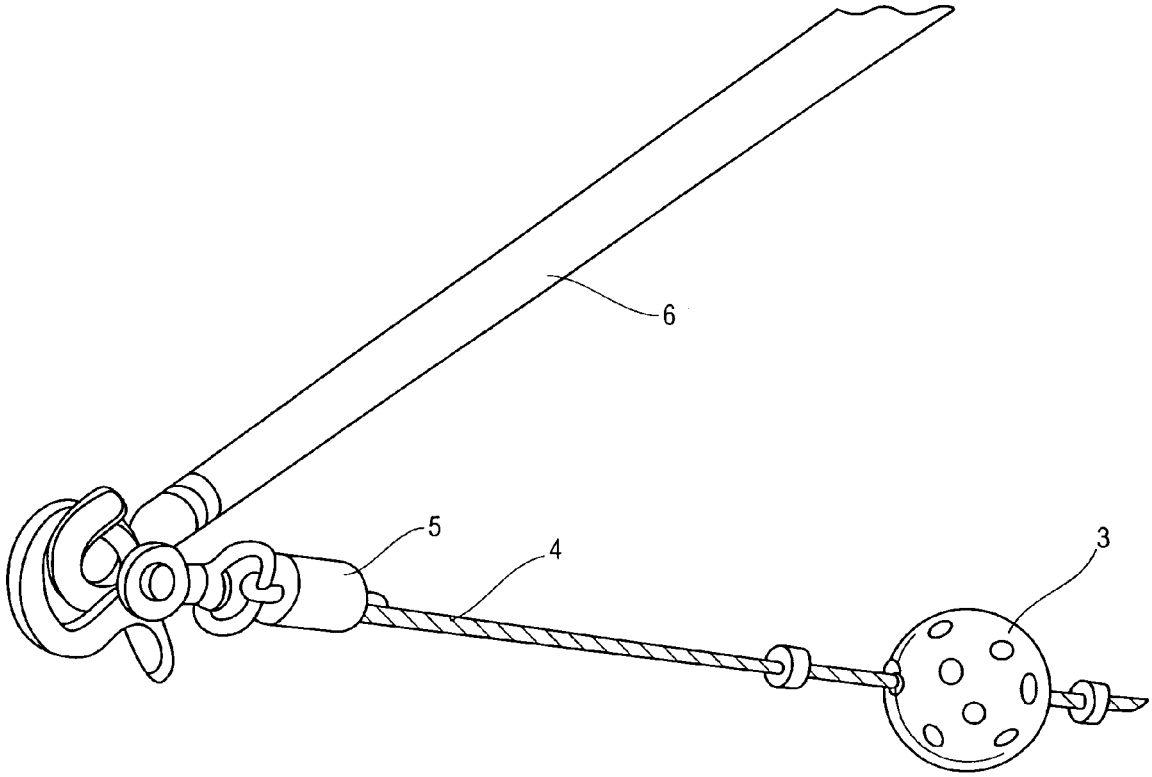
Figure 5:
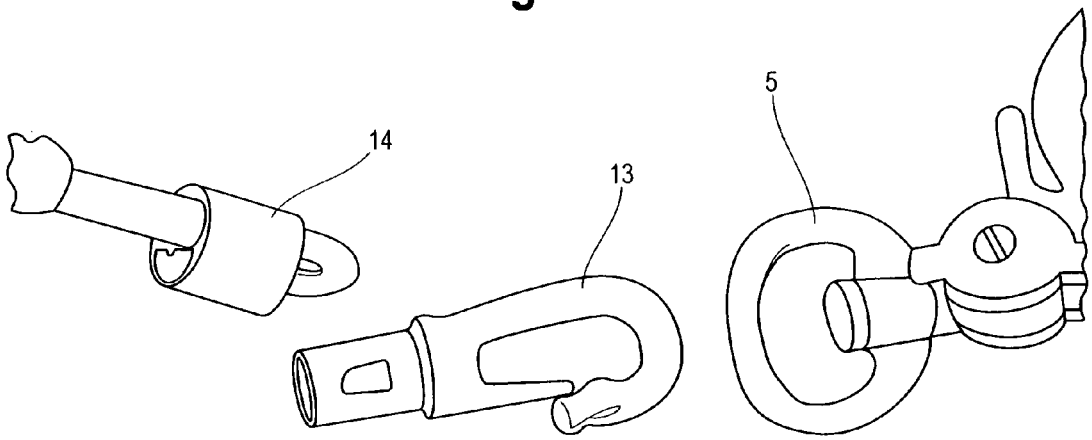
Figure 6:
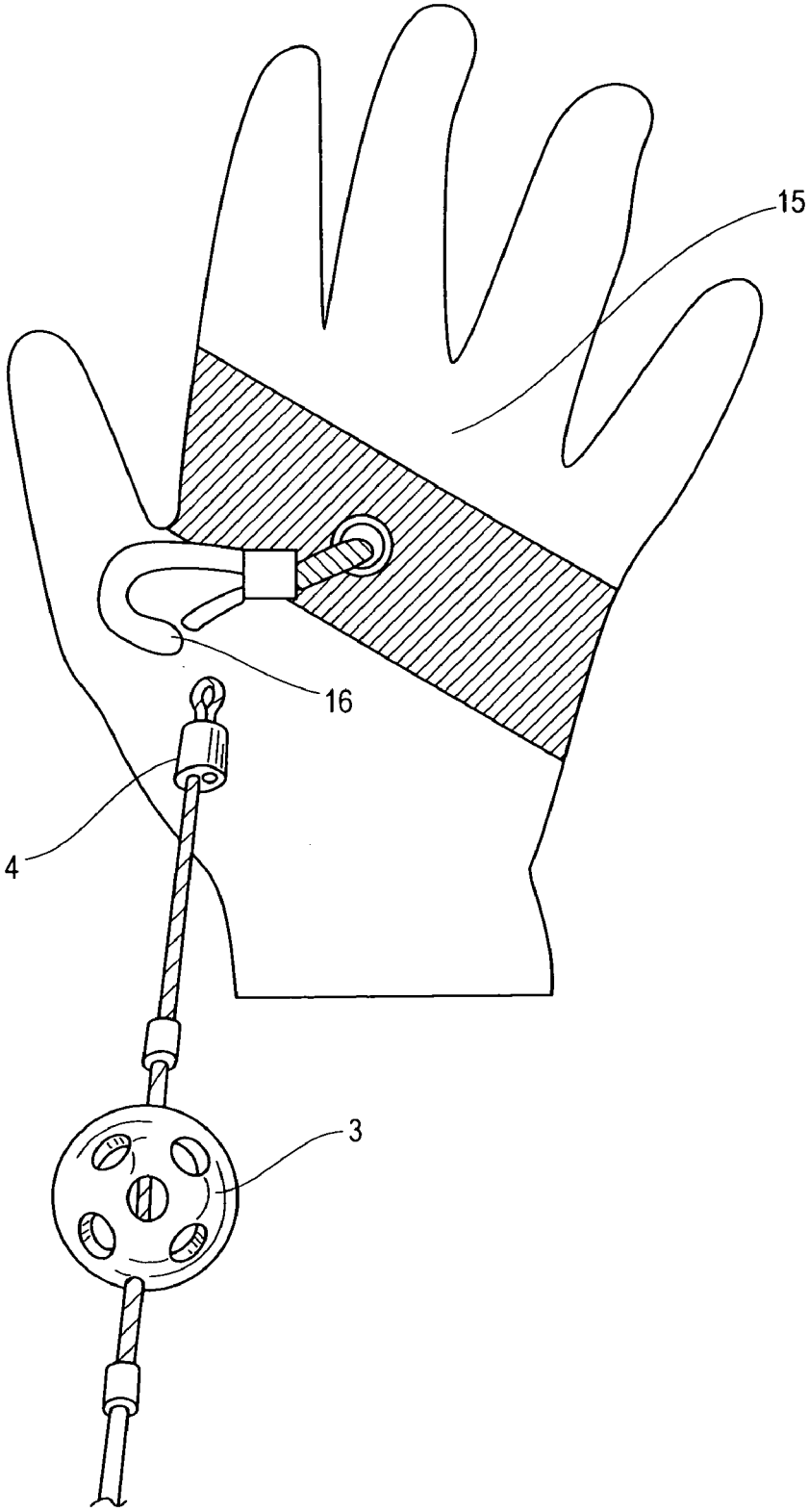

FIG. 4 is a perspective view of the training wand 6 of FIG. 1 illustrating a releasable attachment means for securing the free end 4 of the flexible cord 2, on which a lightweight simulated golf ball 3 is strung, to the end of the training wand 6;

FIG. 5 is a perspective view of three alternative attachment means for alternatively securing the free end 4 of the flexible cord 2 to the training wand 6, or an actual golf club; according to various aspects of the invention; and FIG. 6 is a perspective view of a practice glove adapted to be attached to the free end 4 of the flexible cord 2 according to another aspect of the invention.

DETAILED DESCRIPTION OF THE INVENTION

In the drawings, FIG. 1 shows the complete device of the present invention in position for use. In this embodiment, the device comprises an enclosed spring-loaded retraction reel 1, a flexible cord 2 extending from the reel 1 under tension, and a lightweight simulated golf ball 3. At the free end 4 of the flexible cord 2 is a releasable attachment clip 5 which clips on to one of two or more devices which are used by the user in simulating the motions of a golf swing.

Figure 2:
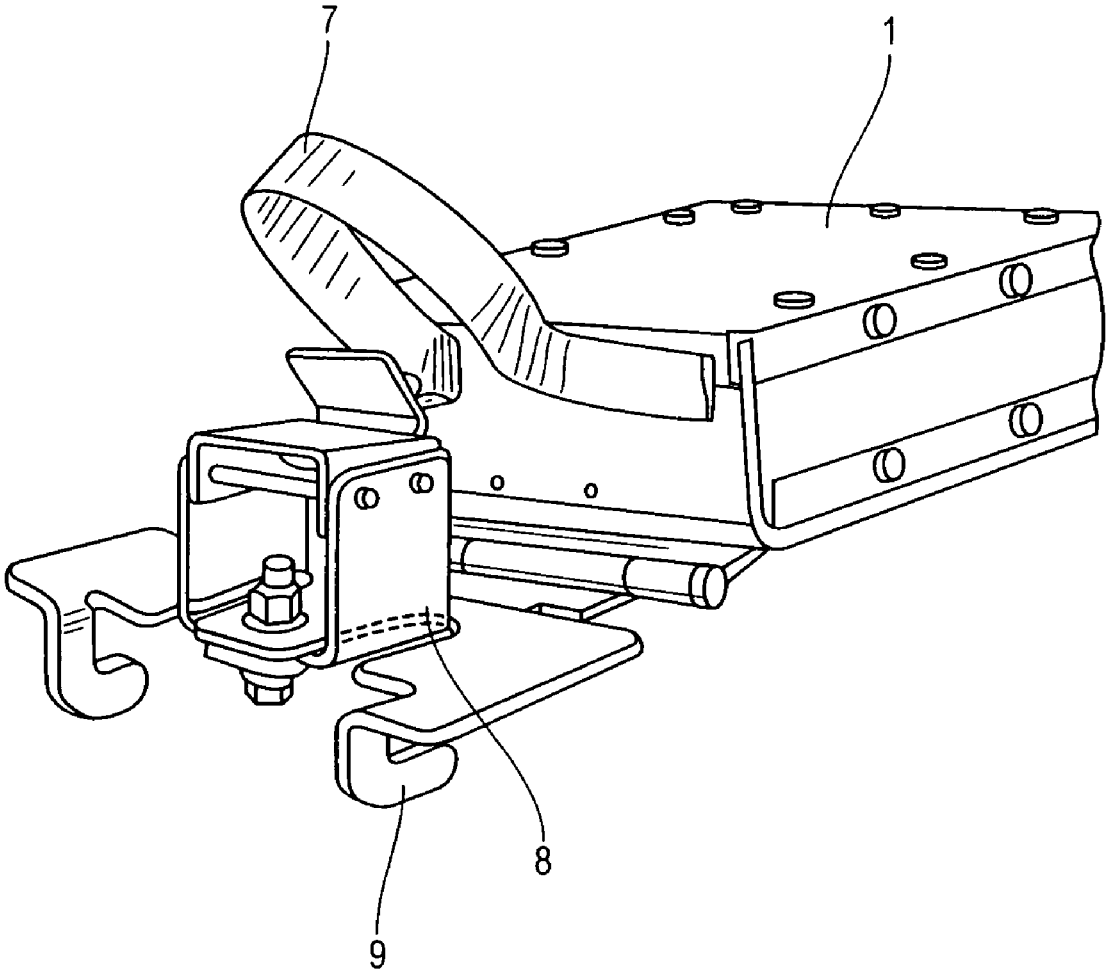
FIG. 2 is a perspective view of the device showing multiple attachment means for securing it to the ground, to a post, or to a floor.
Figure 3:
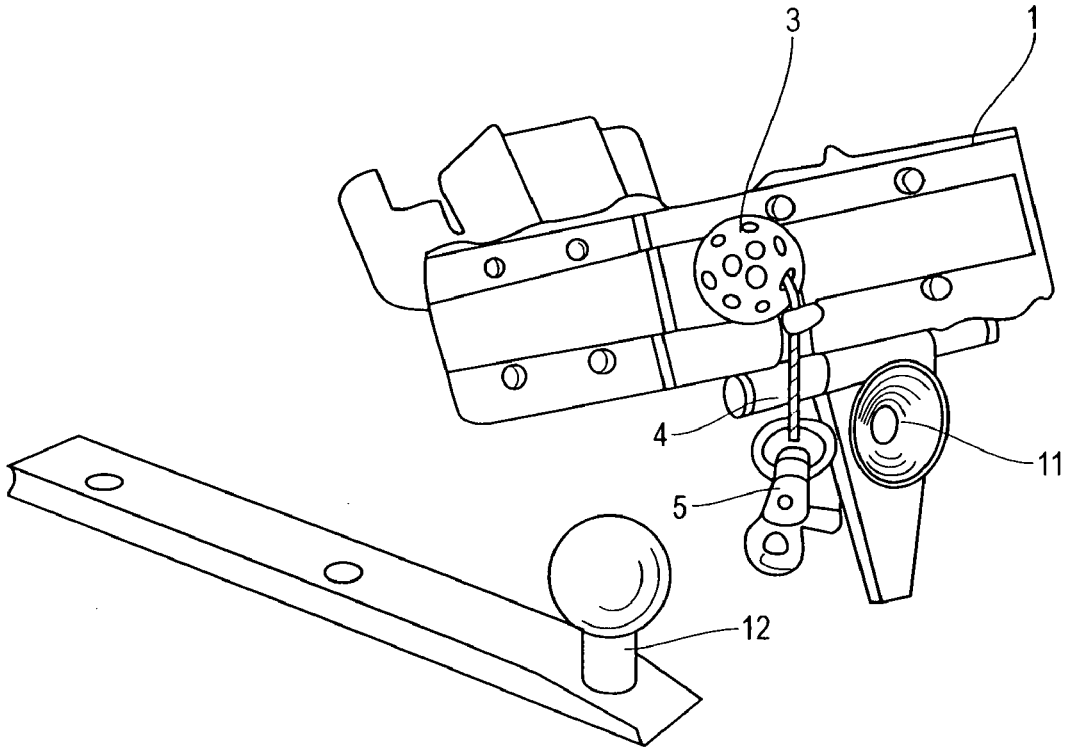
FIG. 3 is a perspective view of the device showing another attachment means using suction cup 11 for securing it to a smooth floor, and a re-usable golf tee 12 for positioning a golf ball, either real or simulated, in position to be addressed by the user in preparing for a golf swing.

At the base of the reel 1 is a multi-function anchor box 8 (FIG. 2) incorporating several securing means. One is a self-securing attachment strap 7 using a buckle or hook-and-loop fasteners to wrap around a tree, post or stake to secure the reel 1 to the ground or, if indoors, against a floor. An alternative means of securing the reel 1 to the ground is a flat sheet metal hook plate 9 which can be pushed into sod or turf and which has a hooked end which digs in tighter under the tension of the flexible cord 2. Another alternative securing means (FIG. 3) is one or more suction cup 11 which releasably secure the reel 1 to any smooth surface, such as a tile floor. For flexibility, both the suction cup 11 and anchor box 8 are attached to the reel 1 by a hinge 10.

To make the use of the device more realistic, a golf ball (either the lightweight simulated golf ball 3 or a real one) can be set up on a reusable tee 12 in front of the user, simulating how the user would address a real golf ball in a golf playing situation. The reusable tee 12 is preferably made of resilient rubber or plastic to withstand repeated impacts from the user's golf club, and is preferably supported on a rigid base made of wood or similar material.

The free end 4 of the flexible cord 2 may be fitted with various attachment means to suit the particular embodiment of the invention which the user desires to use. The releasable attachment clip 5 quickly and easily attaches to the end of the training wand 6, which desirably is fitted with a ring for this purpose. An alternative attachment clip 13 can be slipped over the shaft of an actual golf club just above the club head, for an even more realistic simulation of an actual golf swing. A second alternative attachment clip 14 is adapted to be attached to a special golf glove 15 worn by the user, with the glove being fitted with an attachment point 16 which cooperates with a releasable attachment means at the end of the flexible cord 2.

In the preferred embodiment, the practice ball 3 is positioned on the flexible cord 2 between slidable ball stops 17 made of rubber or like material which may be positioned on the cord 2 at points selected by the user so that after each swing the ball 3 comes to rest at a point in front of the user which approximates the position of a real golf ball being addressed prior to the next golf shot.

The device is used in the following way. The retraction reel 1 is secured to a post, mat, or to the ground. Then the end of the visible flexible cord 2 is attached to the shaft of a golf club. For a beginning golfer or for use indoors where it might be unsafe to swing a full-length golf club, the cord may be attached to a club-like training wand 6 simulating the handle of a golf club but not extending all the way to the ground. With the shorter wand the user need not be concerned about "grounding" the club head or hitting surrounding persons or furniture.

The shorter wand may also be used to simulate the feel and action of putting, providing the golfer with the same kind of valuable visual feedback in practicing this essential part of the game of golf. The invention is configured so that it can be mounted in various locations, including on turf or grass, secured to a golf practice mat, secured to a post or pole. It can be used inside, particularly for putting practice, by securing it to a support post or table leg.

When the device is set up in this manner, the golfer takes a normal stance and grip for addressing an imaginary golf ball located. (For purposes of the following illustration we will assume a right-handed golfer.) The golfer commences to swing by drawing the club or wand 6 backward and upward to the right, pulling the cord from the retraction reel 1 under tension. For convenience, this is referred to as the "pull line".

The pull line is important for the golfer to visualize, because it determines the correctness of the backswing, which in turn is the key to a correct downstroke and follow-through. An important feature of the invention is the enhanced visibility of the flexible cord 2, which is preferably coated with a high-visibility white, yellow or orange surface. By looking down at the imaginary ball, the golfer can see the path of the pull line and thus detect and correct any variance of the club or wand from the preferred path. If the pull line is seen to move outside the ball (away from the golfer), then the golfer is not pulling through correctly. Similarly, if on the downstroke the golfer sees that the pull has moved inside the ball (toward the golfer), the invention makes this error immediately apparent, allowing it to be corrected in the next practice swing.

For maximum benefit, the golfer may start with shortened swings, moving the club just part way through the backswing, downstroke and follow-through, until the pattern of movement has been learned and impressed on the various muscles which are required to act in unified coordination in order to provide the smooth and repeatable golf swing which is critical playing an enjoyable game of golf.

As a another feature of the invention, a lightweight surrogate target golf ball 3, suitably made of knitted cotton, hollow plastic, or any other suitable material, is attached to the cord by, for example, being clipped on or strung through suitably spaced holes. Preferably, the target ball 3 slides freely on the cord so that it stays substantially in the same position relative to the golfer as the cord 2 pulls through it during the backswing, and slides back through it during the downstroke, whereupon it is "hit" by the club or wand 6 going through the point of impact, and carries through with the club or wand for the follow-through. The surrogate golf ball 3 is constrained in its movement along the flexible cord by slidable ball stops, which are positioned according to the user's requirements.

The advantages of the invention therefore include, but are not limited, to the following.

(1) The invention helps the golfer develop a "feel" for the proper way to draw the club or wand back along the pull line;

(2) It helps the golfer develop and learn the correct tempo by pulling the target ball up on the backswing, and then hitting it again on the downstroke;

(3) It helps the golfer develop and learn to coordinate all of the swing movements in the proper rhythm;

(4) It helps the golfer learn how to properly shift weight from one foot to the other in each stage of the swing;

(5) It makes the path of the swing always visible to the golfer, whether it be a straight hit, or the more advanced in-to-out (slice or draw producing), or out-to-in (hook or fade producing) movements.

(6) It also makes visible the elevation of the club head as it passes the point where the ball is addressed, indicating whether it is too high (leading to topping the ball) or too low (causing stubbing or grounding of the club head before it contacts the ball).

(7) The resilient tension of the cord exercises of the important golf swing muscles greater than would be the case if the club were merely swung freely; and (8) It encourages the golfer to maintain a fixed axis from head to trunk, resisting the tendency to "look up" after each shot, because all of the golfer's attention is directed downward at the swing line defined by the visible cord and target ball.

I claim:

1. A golf swing training and exercise device for simulating the motion and dynamics of a golf shot for the user, comprising:

a) a flexible cord having a fixed end and a free end, said fixed end being affixed to a spring-loaded retraction reel means including a rotatable spool upon which said flexible cord is wound and retained for being paid out and reeled back under spring tension;

b) reel housing means for preventing said flexible cord form unintended release from said spool;

c) reel mounting means for securing said reel means to a fixed ground-level position at least one golf-club length from said user in standing position as if to address a golf ball; and d) connection means for connecting said flexible cord free end to at least one hand of said user, e) whereby as said user performs the motions of a golf backswing, downswing and follow-through, said flexible cord is alternately paid out from said reel means under tension and reeled back to said real means under tension, and thereby constantly urging the hand of the user in the direction of the simulated golf shot; and f) including a lightweight surrogate golf ball slidably attached to said flexible cord and positionable in front of said user to simulate the user addressing a golf ball prior to initiating a golf swing.

2. The device of claim 1 further including adjustable ball stop means affixed to said flexible cord for selectively limiting the movement of said surrogate golf ball on said flexible cord.

3. The device of claim 1 in which said lightweight surrogate golf ball is hollow and has a plurality of perforations which provide increased air resistance and allow the flexible cord to be strung therethrough.

4. The device of claim 1 in which said lightweight surrogate golf ball is made of woven fabric stuffed with resilient stuffing material.

5. The device of claim 1 in which said connection means includes a training wand simulating a golf club shaft.

* * * * *